United States Patent [19]

Haneda et al.

[11] Patent Number: 4,494,098

[45] Date of Patent: Jan. 15, 1985

[54] SOLENOID DEVICE

[75] Inventors: Hideo Haneda; Minoru Yamanaka, both of Toyota, Japan

[73] Assignee: Aisin Seiki Kabushiki Kaisha, Toyota, Japan

[21] Appl. No.: 568,567

[22] Filed: Jan. 6, 1984

[30] Foreign Application Priority Data

Jan. 7, 1983 [JP] Japan ..... 58-1000

[51] Int. Cl.[3] ..... H01F 7/08

[52] U.S. Cl. ..... 335/230; 335/79; 335/234

[58] Field of Search ..... 335/229, 230, 234, 261, 335/279, 78, 79, 80, 81, 84, 85

[56] References Cited

U.S. PATENT DOCUMENTS

| | | | |
|---|---|---|---|
| 3,504,315 | 3/1970 | Stanwell | 335/234 |
| 3,775,714 | 11/1973 | Heuer | 335/234 |
| 4,142,166 | 2/1979 | Arnoux | 335/230 X |
| 4,363,980 | 12/1982 | Petersen | 335/234 |

*Primary Examiner*—George Harris

*Attorney, Agent, or Firm*—Sughrue, Mion, Zinn, Macpeak and Seas

[57] ABSTRACT

A solenoid device adapted for use with an automobile door locking device, for example, comprises a shaft, two magnetic cores, a permanent magnet sandwiched between the cores, two field coils for producing a magnetic flux along the shaft, a magnetic yoke body for forming a magnetic flux path along the outsides of the coils, a magnetic center plate disposed between the coils, and two magnetic yoke end plates. The permanent magnet and the cores are fixed to the shaft to form a magnetic plunger. The center plate includes an annular magnetic flux path portion through which the magnetic plunger extends. The width A of the annular magnetic path portion in the direction of the axis of the shaft, the distance B between the end surfaces of the magnetic flux path portion and the respective end surfaces of the yoke end plates, the thickness C of the permanent magnet in the direction of polarization, and the length D of the magnetic cores in the direction of the axis of the shaft are so selected as to satisfy the following relations: $A > C$ and $D \geqq B$.

11 Claims, 10 Drawing Figures

SOLENOID DEVICE

FIELD OF THE INVENTION

The present invention relates to a solenoid device having field coils which, when energized, drive a plunger and, more particularly, to a solenoid device adapted to be used to drive a mechanical system in which a mechanical force required to lock and unlock an automobile door, for example, changes non-linearly with its operating stroke.

BACKGROUND OF THE INVENTION

Referring to FIG. 1, a conventional locking lever LL for actuating a door lock device of an automobile has a torsion spring TS coupled thereto. When the lever LL is operated to lock or unlock the device, the force necessary for the operation assumes a maximum value immediately before a dead point is reached during its stroke, by the action of the spring TS.

Referring next to FIG. 2, this force, or load, is indicated by solid line A which surrounds a hatched region. When the lever is actuated to lock the device, the load which is taken on the ordinate of this graph goes in the positive direction with increasing stroke which is taken on the abscissa. When the lever is actuated to unlock the device, the load goes in the negative direction with increasing stroke. It can be understood from this graph that a force is needed until the dead point is reached in whichever direction the lever is moved, and that a large force is necessary at the beginning of the stroke. The required force then assumes a maximum value with a slight additional stroke.

In an ordinary solenoid device having a single field coil, a plunger attracted by the coil, and a returning spring, the attracting force increases as tne plunger is attracted, as indicated by phantom line B in FIG. 2. Hence, in order to set the force needed at the beginning of the stroke greater than a required force such as the peak value of the curve A, the solenoid device is necessarily made quite large. In the type of device where the plunger is repelled by a field coil, the reverse situation takes place. However, in order to obtain a force greater than the maximum value at a given stroke, a large initial driving force is required to be produced, as indicated by phantom line C in FIG. 2. Therefore, this kind of solenoid device is also made bulky.

In view of the foregoing considerations, solenoid devices producing a driving force whose characteristic curve is similar to the curve A have been proposed. One kind of such conventional devices is shown in FIG. 3, in which a shaft 4 extends through a disk-like permanent magnet 1 of ferrite and through magnetic cores 2 and 3, which are shaped into the form of a truncated cone and are disposed on opposite sides of the magnet 1. This magnet 1 is magnetized with its north and south poles at its two ends. The shaft is provided with annular grooves with which E-rings 5 and 6 engage. These rings support the cores 2 and 3, respectively. Disposed outside of these rings are rubber disks 7 and 8 to absorb mechanical impact. The shaft 4 also extends through these disks 7 and 8. Field coils 9 and 10 are wound on bobbins 11 and 12, respectively. The bobbin 11 is supported by one end plate 13 and the center plate 15 of a magnetic yoke. Similarly, the bobbin 12 is supported by the other end plate 14 and the center plate 15 of the yoke. These bobbins 11 and 12 are housed in the body 16 of the yoke in the form of a cylindrical casing. Both ends of the casing 16 is crimped inwardly such that the end plates 13, 14, the bobbins 11, 12, center plate 15, and the casing 16 are joined together.

When an electric current is supplied in the direction indicated by the arrow A in FIG. 3, the end plate 13 and 14 of the yoke are magnetized to exhibit north poles, while the center plate 15 is magnetized to exhibit a south pole. Since the left and right sides of the permanent magnet 1 are south and north poles, respectively. Accordingly, when the device is energized with the current flowing in the direction indicated by the arrow A, the plunger core 5 is attracted towards the end plate 13 and, at the same time, it is repelled by the center plate 15, whereby the core 5 is urged in the direction indicated by the arrow B. Likewise, the plunger core 3 is repelled by the end plate 14 while attracted by the center plate 15, so that the core 3 is also urged in the same direction. Thus, these cores push the shaft 4 to move it in the direction indicated by the arrow B until the rubber disk 7 abuts on the end plate 13, at which time the shaft comes to a halt. After this movement of the shaft 4 to the left (in the direction indicated by the arrow B), the current supplied in the direction indicated by the arrow A is reversed. Then, the end plates 13 and 14 are polarized south, while the center plate 15 is polarized north. This moves the shaft 4 to the right (in the opposite direction to the direction B), and then it halts in the condition shown in FIG. 3. The solenoid device thus far described is used as a driving source for automatically locking and unlocking a vehicle door, for instance.

In this kind of solenoid device where the plunger is disposed in the space inside of the coils and is driven by tne attracting and repelling forces of the magnetic field set up by the coils, the fringes of the cylindrical casing, or the main yoke, are crimped so as to be firmly secured to the end plates 13 and 14, as shown in FIG. 3, such that the end plates 13, 14, the bobbins 11, 12, the center plate 15, and the main yoke 16 are joined together. In this structure, the gap between the end plates 13 and 14, more specifically the gap between the end plate 13 and the center plate 15 and the gap between the end plate 14 and the center plate 15, is determined by the dimensions of the end plates 13, 14, the bobbins 11, 12, the main yoke 16, the center plate 15, the strength of the crimping at both ends of the yoke 16, and the direction of the applied pressure. In this way, the parameters which affect the gap are numerous, and therefore the error varies greatly from product to product. Especially, the error of products attributable to the crimping poses a serious problem. Further, since the crimping applies a force to the coil bobbins, these bobbins are forced to have a large wall thickness. This introduces such an undesirable situation that the diameter of the solenoid is large.

SUMMARY OF THE INVENTION

It is an object of the present invention to provide a solenoid device which produces an acting force, that is applied efficiently in conformity with its given nonlinear relation to stroke, and which can be miniaturized.

It is another object of the invention to provide a solenoid device which can be manufactured with a less variation from product to product.

These objects are achieved by a device which comprises, as shown in FIG. 3, two field coils, a center plate 15 disposed between these coils and having an annular magnetic flux path portion, and end plates 13 and 14 of a yoke having annular end surfaces opposed to the annular end surfaces of the plate 15, the width A of the plate 15 along a shaft being greater than the thickness C of a permanent magnet 1 (A>C), the length D of magnetic cores 2, 3 along the shaft being greater than or equal to the distance B between the end surfaces of the plate 15 and the respective end surfaces of end plates 13, 15 (D≧B). This arrangement can yield a characteristic of tne driving force which accomodates the relation between the acting force and stroke to the curve A (FIG. 2). Consequently, the solenoid device can be made compact and can effect a more efficient driving.

In one preferred embodiment of the invention, the body of a yoke consists of a plurality of sections. The yoke body cooperates with one of the end plates of the yoke to form a recess which extends substantially perpendicular to the axis of a plunger. The other end plate is provided with a protruding portion that comes into engagement with the recess. When the protruding portion is inserted in the recess, the end plates engage with the yoke body. The inner wall of the outer casing of this device supports the yoke body and maintains this engagement.

The yoke body is divided into two, for example, on the plane containing the center axis of the body. Both ends of each half has a protruding portion which is provided with a semicircular opening. The outer periphery of each end plate is formed with an annular groove or recess with which the semicircular fringe of the protruding portion engages to form an external magnetic flux path of the coils. This yoke assembly is inserted in an outer cylinder made from synthetic resin and having an inner space which conforms to the contour of the assembly, so that it is held generally.

In the novel device described just above, the magnetic loop gaps, such as yoke end plate gaps, are determined by tne combination of the yoke body and the end plates, reducing variation from product to product. Further, since no force is applied to the coil bobbins in assembling the components, the wall of the bobbins can be made thinner. Additionally, the bobbins can be substantially omitted. A further advantage is that the processes for assembling the device are rendered simpler.

Other objects and features of the invention will appear in the course of description that follows.

BRIEF DESCRIPTION OF THE DRAWINGS

FIGS. 5*a*–5*c* are perspective views showing the appearances of different components of the solenoid device shown in FIG. 4*a.

DETAILED DESCRIPTION OF THE INVENTION

Figure 4A:
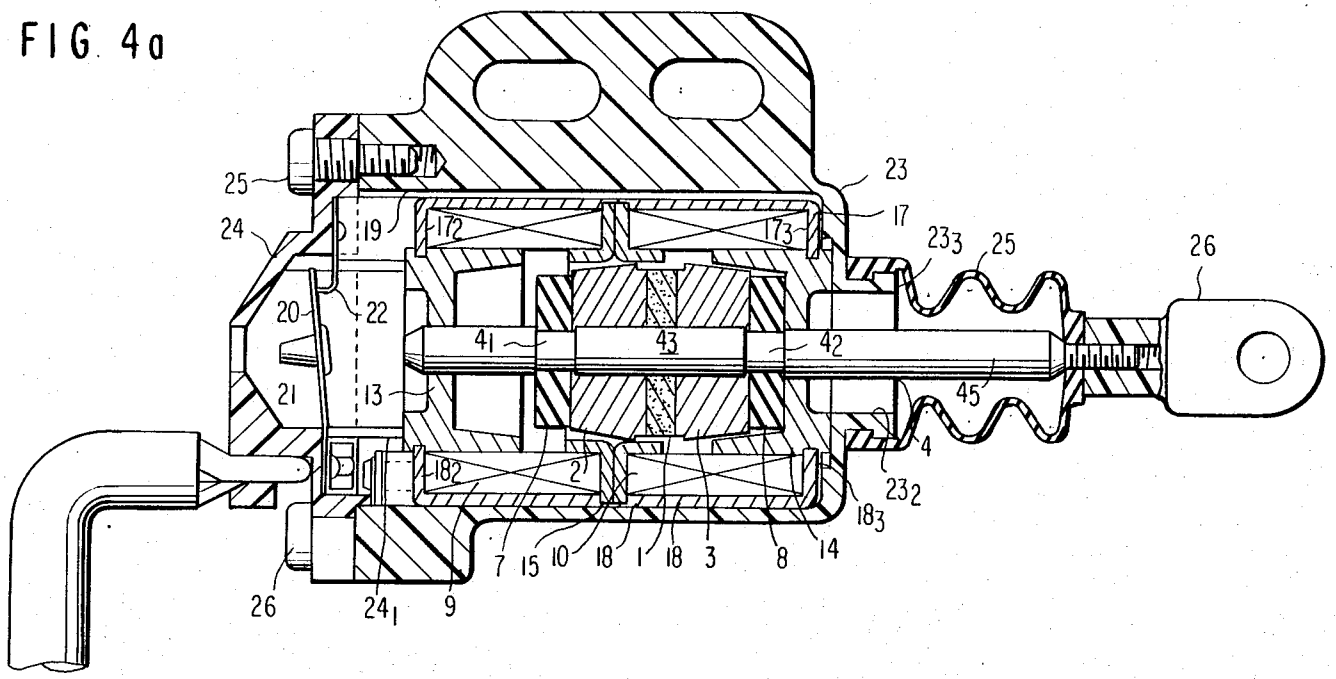
FIG. 4*a* is a longitudinal sectional view of a solenoid device according to the present invention.

Referring to FIG. 4*a*, there is shown a solenoid device embodying the concept of the present invention. This device is designed to be used as the driving source for automatically locking and unlocking an automobile door, and it includes a shaft 4 having a portion $4_3$ through which a plunger passes. In the shaft 4, annular grooves $4_1$ and $4_2$ are formed at the opposite sides of the portion $4_3$ such that portions $4_4$, $4_3$ and $4_5$ of the same diameter bulge out relative to the portions where the grooves $4_1$ and $4_2$ are formed. Disks 7 and 8 made of relatively hard rubber are mounted in the grooves 7 and 8, respectively. When no external force is applied to these components and hence they are not deformed, the diameter of the holes formed in the disks 7 and 8 are less than that of the bulging portions $4_4$, $4_3$, $4_5$ and of the same order or somewnat less than that of the annular grooves 7, 8.

Figure 5A:
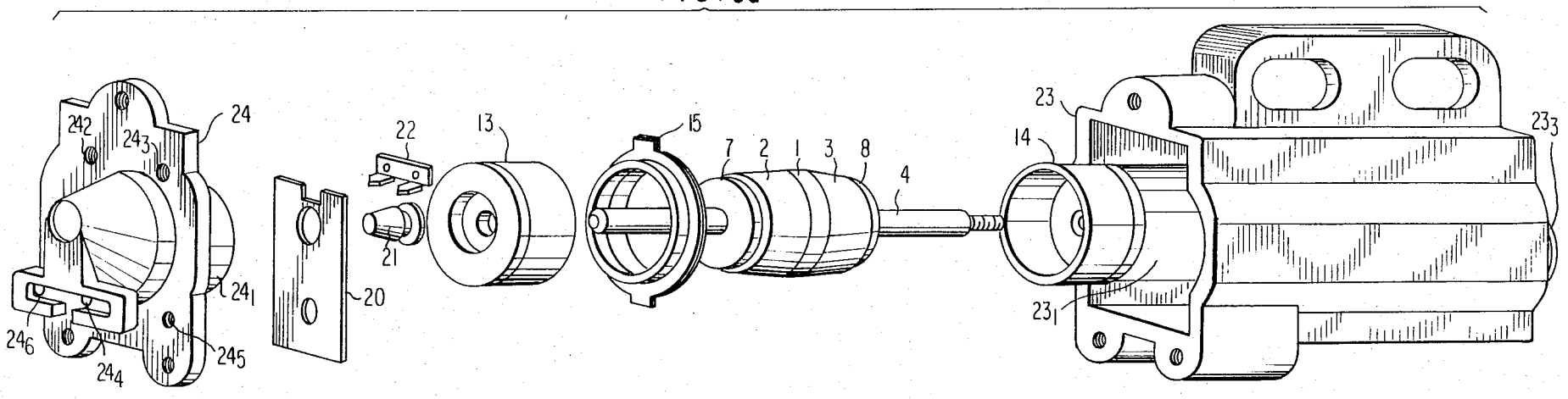

First, the shaft 4 is inserted into the hole in the disk 8 with a relatively strong force to bring the disk 8 into engagement with the annular groove $4_2$. Then, the shaft 4 is passed through holes which are formed in a plunger core 3, a permanent magnet 1 made from a rare earth magnetic material, for example, a plunger core 2, and the disk 7, respectively, in this order. Thereafter, the disk 7 is pressed against the core 2 with a considerably strong force to bring it engagement with the groove $4_1$, whereby completing an assembly of the shaft 4 and the plunger. The appearance of this assembly is shown in FIG. 5*a* in exploded view.

In this illustrative example, the length of the portion of the portion $4_3$ of the shaft 4 along its axis is made slightly less than the sum of the thicknesses of three components, i.e., the cores 3, 4 and the magnet 1. The thickness of the disks 7 and 8 are selected to be of the same order as the width of the grooves $4_1$ and $4_2$. As a result, when the plunger and the shaft are assembled into a unit as shown in FIGS. 4*a* and 5*a*, the rubber disks 7 and 8 are slightly compressed by the cores 2 and 3, respectively. This prevents the plunger assembly from getting loose from the shaft 4.

Figure 5B:
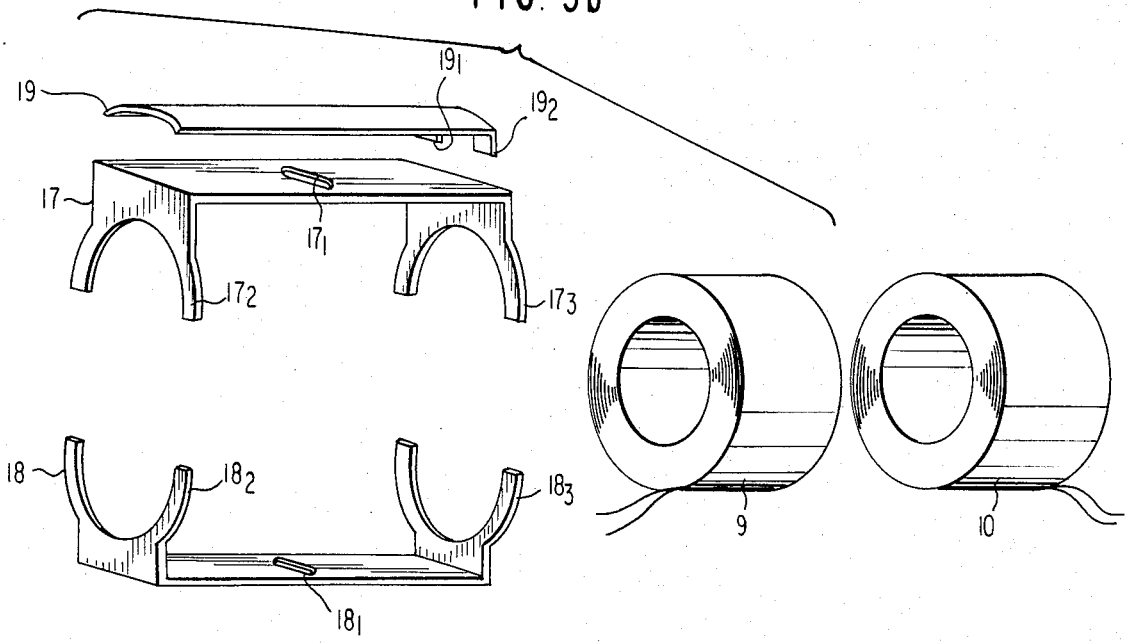
Figure 5C:
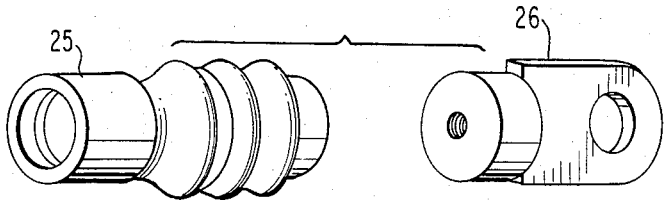

Referring again to FIG. 4*a*, the shaft 4 extends through yoke end plates 13 and 14 which are connected togetner by means of two yoke bodies 17 and 18. The appearance of each of the yoke bodies 17 and 18 are shown in FIG. 5*b*. The yoke bodies 17 and 18 are centrally provided with long holes $17_1$ and $18_1$, respectively, and a center plate 15 has protrusions inserted into these holes as shown in FIG. 4*a*. The appearance of the plate 15 is shown in FIG. 5*a*. The yoke bodies 17 and 18 have protrusions $17_2$, $17_3$ and $18_2$, $18_3$, respectively, at their both ends, each of the protrusions being provided with a semicircular opening, as shown in FIG. 5*b*. These protrusions are inserted into annular grooves which are formed in the cuplike end plates 13 and 14 as shown in FIG. 4*a*. More specifically, the yoke body 17 is opposed to the yoke body 18 in such a way that the front ends ot the protrusions $18_2$ and $18_3$ abut on the front ends of the protrusions $17_2$ and $17_3$, respectively. This will cause the protrusions $17_2$ and $18_2$ to surround a circular opening formed thereby and cause the protrusions $17_3$ and $18_3$ to surround a similar circular opening. The annular grooves in the end plates 13 and 14 are positioned in these holes. At the same time, the protrusions $17_2$ and $18_2$ engage with the annular groove in the end plate 13, and the protrusions $17_3$ and $18_3$ engage with the annular groove in the end plate 14. By virtue of these engagements, the end plates 13 and 14 are spaced apart a certain distance.

Referring again to FIG. 4*a*, a first field coil 9 is surrounded by the protrusions $17_2$, $18_2$ outside of the end plate 13 and also by the center plate 15. Similarly, a second field coil 10 is surrounded by the protrusions $17_3$, $18_3$ outside of the end plate 14 and also by the center plate 15. It is to be noted that coil bobbins are omitted.

The appearance of each of the coils 9 and 10 is shown in FIG. 5*b*. Each of these coils is formed by winding an insulated wire that is covered with heat-sealing and insulating resin around a former coated with remover into the form of a coil, then heating the assembly, and removing the winding from the former after cooling the assembly. Under normal condition, these coils retain the shapes shown in FIG. 5*b*. The cuplike yoke end plates 13 and 14 are inserted into the coils 9 and 10, respectively. The plunger-shaft assembly is inserted into the center plate 15 as shown in FIG. 5*a*. The shaft of the plunger-shaft assembly is inserted into the end plates 13 and 14, on which the coils 9 and 10 are mounted, respectively, in the manner shown in FIG. 5*a*. One of the two protrusions of the center plate 15 is inserted into the long hole $17_1$ in the yoke body 17, and the other is inserted into the long hole $18_1$ in the yoke body 18. The protrusions $17_2$, $17_3$ and $18_2$, $18_3$ of the yoke bodies 17 and 18 are inserted into the annular groove in the end plate 13, whereby assembling the plunger-shaft assembly 1-4, 7, 8, the end plates 13, 14, the center plate 15, and the yoke bodies 17, 18 into a coil-plunger assembly.

This coil-plunger assembly is inserted into an outer cylinder 23 together with a leaf spring 19. The appearance of the cylinder 23 is shown in FIG. 5*a*. The cylinder is provided with a space $23_1$ to receive the coil-plunger assembly. A hole $23_2$ (FIG. 4*a*) of a relatively large diameter is formed at the bottom so that the shaft 4 may extend therethrough. This hole $23_2$ extends in the direction of the axis of the shaft, and a cylindrical flange $23_3$ is formed.

The appearance of the leaf spring 19 is shown in FIG. 5*b*. The spring 19 is usually bent and thin, and it has two upstanding portions $19_1$ and $19_2$. Normally, the width of the spring 19 is less than that of the top plate portion of the yoke body 17.

The inner space $23_1$ of the outer cylinder 23 is shaped so that the coil-plunger assembly is received in it and that the leaf spring 19 is received in it while somewhat unbent. In mounting the coil-plunger assembly 1-4, 7-10 in the cylinder 23, the spring 19 is moved along the top plate portion of the yoke body 17 (FIG. 5*b*) while its upstanding portions $19_1$ and $19_2$ are in contact with the outside of the protrusion $17_3$. then, the protrusions $17_3$, $18_3$ and the upstanding portions $19_1$, $19_2$ are inserted into the space $23_1$ in the cylinder $23_1$, after which the whole spring 19 is inserted into it. During this insertion, the spring 19 is somewhat unbent. After the completion of the insertion, i.e., in the state shown in FIG. 4*a*, the resilience of the spring 19 biases the yoke body 17 toward the yoke body 18 at all times.

The inner space $23_1$ of the cylinder 23 is closed off by a cover 24 of synthetic resin. A protruding wall $24_1$ shaped into a substantially cylindrical form pushes the end plate 13 and is formed integrally with the cover 24 on the inner side of the cover 24. The wall $24_1$ is divided into two, forming a space to receive a movable switching plate 20 and a stationary switching plate 22 and to permit movement of the movable plate 20. A rubber piece 21 is firmly fixed to the plate 20 in the position in which the front end of the shaft 4 abuts on it. The switching plates 20 and 22 are securely fixed inside of the cover 24, as shown in FIG. 4*a*. The appearance of the cover 24 is shown in FIG. 5*a*.

After inserting the coil-plunger assembly 1-4, 7-10 and the leaf spring 19 into the outer cylinder 23, as described above, the electrical leads of the coils 9 and 10 are passed through lead holes $24_4$ and $24_5$, respectively, formed in the cover 24, and then the cover 24 is securely fixed to the cylinder 23 with screws 25–27. Thus, the protruding wall $24_1$ of the cover 24 presses down the end plate 13. Before the cover 24 is fixed to the cylinder 23, the switching plates 20 and 22 are securely fixed to the cover, the leads are connected to the plates, the leads being brought out through holes $24_2$ and $24_3$. The leads of tne coils 9, 10 and the leads of the switching plates 20, 22 are held in a lead holder $24_6$ formed in the cover 24.

The switching plates 20 and 22 permit detection of the operation condition of the present solenoid device. When the plunger-shaft assembly is at the left side in FIG. 4*a*, the front end of the shaft 4 pushes the rubber plate 21 to the left, keeping the switching plate 20 away from the plate 22, i e., the switching device is open. On the other hand, when the shaft 4 is at a distance from the plate 21, as shown in in FIG. 4*a*, the resilience of the plate 21 biases it clockwise and so the plate is kept in contact with the plate 22, i.e., the switching device is closed.

Tne cylindrical flange $23_2$ of the outer cylinder is inserted into one end of a rubber bellows 25. The right end of the shaft 4 is inserted into a hole formed in the other end of the bellows 25. The bellows 25 is firmly secured to the shaft 4 by screwing a connector 26 into the shaft 4 and tightening the connector.

Figure 4C:
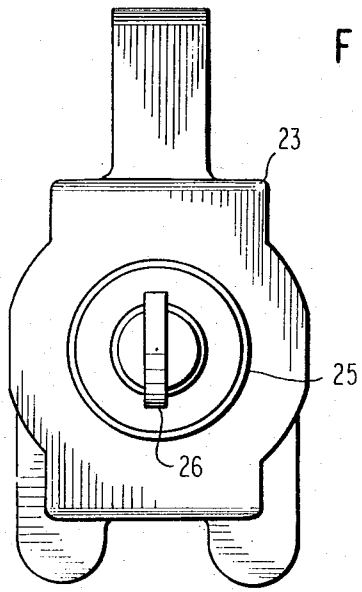
FIG. 4*c* is a right side elevation of the device shown in FIG. 4*a;*
Figure 4B:
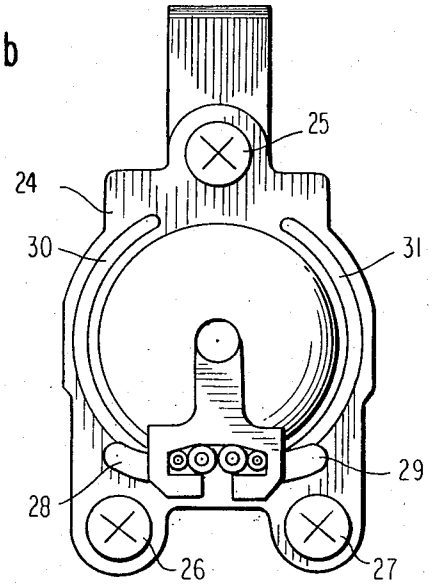
FIG. 4*b* is a left side elevation of the device shown in FIG. 4*a;*

The solenoid device thus far described is shown in FIG. 4*a* in longitudinal cross section. The left and right side elevations of the device are shown in FIGS. 4*b* and 4*c*, respectively. As shown in FIG. 4*b*, the electrical leads connected to field coils 9 and 10 are indicated by reference numerals 28 and 29, respectively. The electrical leads connected to the switching plates 22 and 20 are indicated by numerals 30 and 31, respectively.

Figure 6:
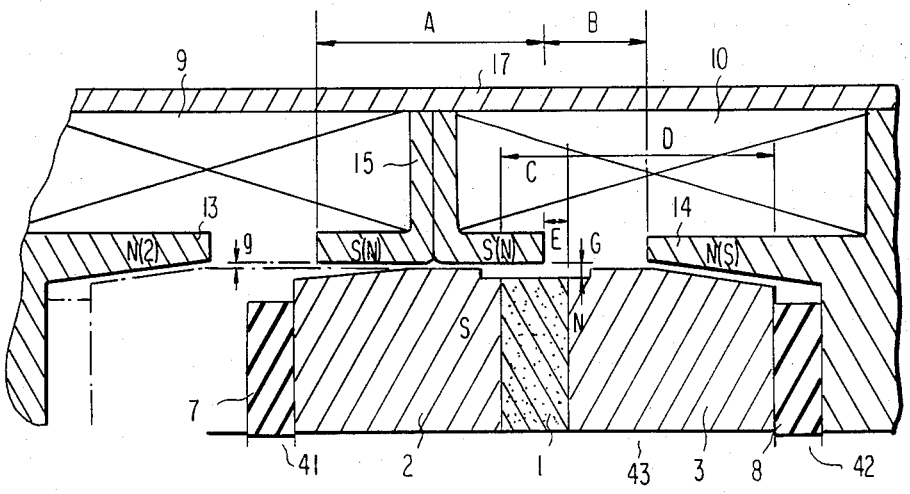
* and FIG. 6 is an enlarged sectional view of a portion of the device shown in FIG. 4*a*.
Figure 3:
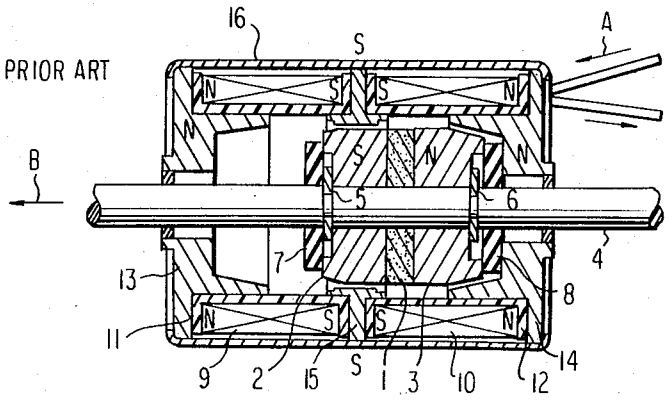
FIG. 3 is a longitudinal sectional view of a conventional solenoid device.

A portion of FIG. 4*a* is shown in FIG. 6 on an enlarged scale. Now let A be the width of the annular portions of the center plate 15, B be the distance between the ends of the annular portions and the respective ones of the yoke end plates 13 and 14, C be the thickness of the permanent magnet 1, D be the axial length of the cores 2 and 3, E be the distance between the end of one pole of the magnet 1 and the nearer end of the center plate 15 when the plunger has moved its full stroke as shown, G be the space between the inner surface of the center plate 15 and the outer surface of the magnet 1, and g be the space between the outside of the cores 2 and 3 and the inner surface of the center plate. In the above embodiment, the dimensions are determined as listed in Table 1 below.

TABLE 1

| | | |
|---|---|---|
| A = 10 mm; | B = 4.5 mm; | C = 3 mm |
| D = 9 mm; | G = 0.4 mm | g = 0.2 mm |

Figure 1:
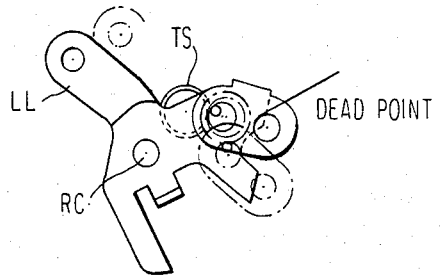
FIG. 1 is a plan view of the operation portion of a door locking device equipped in an automobile.
Figure 2:
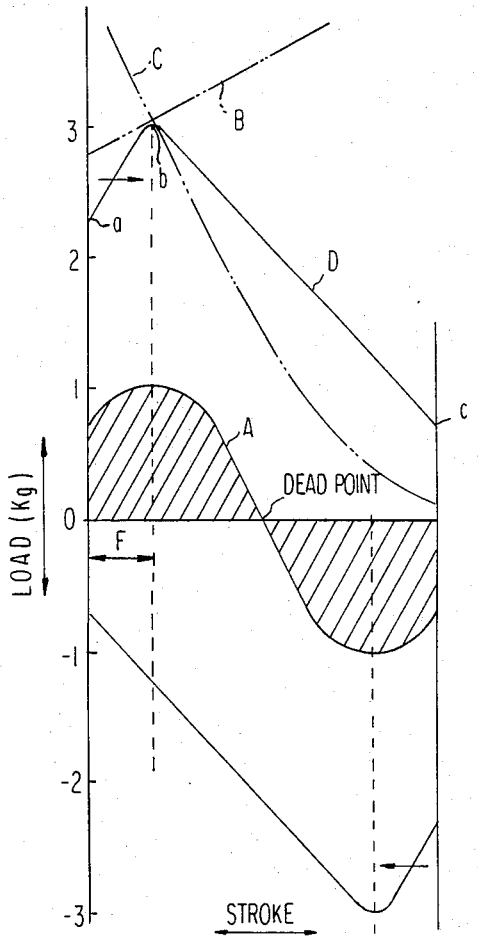
FIG. 2 is a graph showing tne relation of the forces necessary for locking and unlocking the device shown in FIG. 1 to the force produced by a solenoid device.

In order to move the plunger to tne left under the condition shown in FIG. 6, an electric current is supplied to the coils 9 and 10 in such a direction that the center plate is polarized south and the end plates 13 and 14 are polarized north. At this time, a force at point a on the curve D shown in FIG. 2 is applied to the plunger. This force is the sum of the following four forces: (1) the repulsive force between the core 3 and the end plate 14; (2) the attracting force between the core 3 and the center plate 15; (3) the repulsive force between the center plate 15 and the core 2; and (4) the attracting force between the core 2 and the end plate 13. Since the north pole of the magnet 1 is close to the center plate 15 on the right side of the plate 15, as shown in FIG. 6, the force (2) above is greatest. When the plunger begins to move to the left, the distance between the north pole of the magnet 1 and the right end of the center plate 15 reduces, thus increasing the force (2) rapidly. The force (4) is also increased. When the magnetic flux emanating from the north pole of the magnet 1 is concentrated most densely at the right fringe of the center plate 15, i.e., when the plunger has been moved a distance substantially equal to E, the force (2) assumes a maximum value as indicated by point b on the curve D in FIG. 2. As the plunger is moved further to the left, the force (2) reduces rapidly, but the force (4) increases gradually. As a result, the driving force to the left which is the sum of the forces (2) and (4) decreases gradually, as indicated by the interval b-c on the curve D of FIG. 2. In the condition where the plunger has been moved to the leftmost position, the force (4) predominates in the force acting on the plunger.

Accordingly, assuming in the above embodiment that $E=F$ (F is the operating stroke at which the load due to the driven mechanism peaks), the distance between the right (or left) end of the center plate 15 and the core 3 (or 2) assumes a minimum value when the plunger has moved the distance F. To achieve this condition, the requirements $A>C$ and $D\geqq B$ as indicated in Table 1 are satisfied. In particular, if the relationship $A<C$ is established, then after the plunger moves to the peak point the force (3) increases rapidly, and the inclination in the interval b-c on the curve D of FIG. 2 becomes less steep. The result is that the plunger is caused to strike the end plate 13 with a great force. If the relation $D<B$ is established, then the forces at the points a and c (FIG. 2) becomes smaller, so that the plunger is not readily moved at the beginning of the driving operation. Further, after arrival at the dead point, the force becomes smaller rapidly. This makes the arrival at the other end uncertain. In view of the foregoing considerations, the present invention makes use of the relations $A>C$ and $D\geqq B$, which yields a solenoid device that is quite small, operates efficiently and stably, and produces a less impact.

In the above embodiment, the solenoid device has the plunger cores 2 and 3 supported by the resilient members 7 and 8 that engage with the shaft 4, and therefore even if the dimensional accuracy of the plunger cores and the permanent magnet is low, no components of the device will come loose. Another advantage is that the plunger unit can readily be coupled to the shaft. Although the leaf spring 19 presses one yoke body 17 against the end plates 13 and 14, thereby pressing these end plates against the other yoke body 18 in the above embodiment, it is also possible to omit the spring 19 and to insert the yoke assembly into the outer cylinder 23 of synthetic resin with a moderate tightness. In this alternative embodiment, the cylinder 23 is preferably made from slightly resilient or flexible synthetic resin.

Obviously many modifications and variations of the present invention are possible in the light of the above teachings. It is therefore to be understood that within the scope of the appended claims the invention may be practiced otherwise than as specifically described.

What is claimed is:

1. A solenoid device comprising:

a shaft, a permanent magnet, two magnetic cores disposed on the sides of the north and south poles, respectively, of the permanent magnent, the permanent magnet being sandwiched between the cores such that these constitute a magnetic plunger fixed to the shaft, two field coils for producing magnetic flux along the shaft, a magnetic yoke body for forming a magnetic flux path along the outsides of the coils, a magnetic center plate disposed between the coils and having an annular magnetic flux path portion through which the magnetic plunger extends, the center plate further having flange portions that constitute magnetic flux paths between the annular magnetic flux path portion and the yoke body, and two magnetic yoke end plates each of which is coupled to the yoke body and has an annular wall protruding into respective one of the coils in such a way that the end surfaces of the end plates are opposed to the end surfaces of the annular magnetic flux path portions, the width A of the annular magnetic flux path portion in the direction of the axis of the shaft, the distance B between the end surfaces of the magnetic flux path portion and the respective end surfaces of the yoke end plates, the thickness C of the permanent magnet in the direction of polarization, and the length D of the magnetic cores in the direction of the axis of the shaft satisfying the following relations:

$A>C$ and $D\geqq B$.

2. A solenoid device as set forth in claim 1, wherein the magnetic plunger is provided with a hole through which the shaft extends, and wherein the magnetic plunger comprises:

the permanent magnet magnetized in the direction of the center axis of the hole, the two magnetic cores disposed on the sides of the north and south poles, respectively, of the permanent magnet, each of the cores being provided with a hole through which the shaft extends, the shaft extending through the holes in the permanent magnet and in the magnetic cores and provided with recesses near the outsides of the cores, and resilient members having portions that engage with the recesses and other portions that abut on the sides of the cores to push the cores towards the permanent magnet.

3. A solenoid device as set forth in claim 2, wherein each of the recesses in the shaft is an annular and circumferential groove.

4. A solenoid device as set forth in claim 3, wherein each of the resilient members is provided with a hole that engages with respective one of the grooves in the shaft, the diameter of the holes being less than the diameter of the portions of the shaft on both sides of the grooves.

5. A solenoid device as set fortn in claim 1, wherein the yoke body is divided into a plurality of sections, the yoke body and one of the yoke end plates having recesses which extend substantially perpendicular to the axis of the plunger, the other yoke end plate having protrusions which come into engagement with the recesses to bring the yoke end plates into engagement with the yoke body, the inner wall of the outer casing of the solenoid device acting to support the yoke body for maintaining that engagement.

6. A solenoid device as set forth in claim 5, wherein said protrusions extend perpendicularly from both ends of the longitudinal portion of the yoke body which lies in the direction of the axis of the coils, each of the protrusions being provided with an opening which forms a portion of a circle, each of the recesses being an annular groove that is formed in the periphery of each yoke end plate so as to correspond to the circle.

7. A solenoid device as set forth in claim 5, wherein the yoke body is divided into two, said protrusions extending perpendicularly from both ends of the longitudinal portion of the yoke body that lies in the direction of the axis of the coils, each of the protrusions being provided with an opening which forms a portion of a circle, each of the recesses being an annular groove that is formed in the periphery of each yoke end plate so as to correspond to the circle.

8. A solenoid device as set forth in claim 5, further comprising a spring means interposed between the outer casing and the yoke body to push at least one section of the yoke body towards the other section or sections.

9. A solenoid device as set forth in claim 8, wherein the spring means is a leaf spring which is usually bent and which is disposed in the gap between the inner wall of the outer casing and the backside of one section of the yoke body while somewhat unbent.

10. A solenoid device as set forth in claim 5, wherein the field coils are disposed outside of cylindrical protrusions formed on the yoke end plates and are placed between protrusions at both ends of the yoke body without using bobbins.

11. A solenoid device as set forth in claim 10, wherein the protrusions of the yoke body extend perpendicularly from both ends of the longitudinal portion that lies in the direction of the axis of the coils, each of these protrusions being provided with an opening which forms a portion of a circle, eacn of the recesses in the yoke end plates being an annular groove corresponding to the circle.

* * * * *